US010095189B2

(12) United States Patent
Masserot et al.

(10) Patent No.: US 10,095,189 B2
(45) Date of Patent: Oct. 9, 2018

(54) ANALOG TYPE WATCH AND TIME SET METHOD

(71) Applicant: Withings, Issy les Moulineaux (FR)

(72) Inventors: Jocelyn Masserot, Issy les Moulineaux (FR); Victor Ting, Issy les Moulineaux (FR); Marie Loubiere, Paris (FR); Eric Carreel, Meudon (FR)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 14/303,009

(22) Filed: Jun. 12, 2014

(65) Prior Publication Data

US 2015/0362893 A1 Dec. 17, 2015

(51) Int. Cl.

| | |
|---|---|
| ***G04C 3/14*** | (2006.01) |
| ***G04G 5/00*** | (2013.01) |
| ***G04R 20/26*** | (2013.01) |
| ***G04G 21/00*** | (2010.01) |

(52) U.S. Cl.

CPC ..... *G04G 5/00* (2013.01); *G04C 3/146* (2013.01); *G04G 21/00* (2013.01); *G04R 20/26* (2013.01)

(58) Field of Classification Search

CPC ..... G04C 3/146; G04C 3/008; H02K 37/12; G04R 20/26; G04G 21/00; G04G 5/00

See application file for complete search history.

(56) References Cited

U.S. PATENT DOCUMENTS

| | | | | | |
|---|---|---|---|---|---|
| 3,763,648 | A * | 10/1973 | Pakter | G04B 45/0038 | 368/238 |
| 4,969,133 | A | 11/1990 | Triponez | | |
| 5,299,177 | A | 3/1994 | Koch | | |
| 5,500,835 | A | 3/1996 | Born | | |
| 5,500,935 | A | 3/1996 | Born | | |
| 5,724,316 | A * | 3/1998 | Brunts | G01C 21/3697 | 340/988 |
| 5,982,710 | A * | 11/1999 | Rawat | G04G 9/0076 | 368/21 |
| 6,219,303 | B1 * | 4/2001 | Morohoshi | G04G 5/00 | 368/187 |

(Continued)

FOREIGN PATENT DOCUMENTS

WO 2014207220 12/2014

*Primary Examiner* — Sean Kayes

(74) *Attorney, Agent, or Firm* — Miller, Matthias & Hull LLP

(57) ABSTRACT

Interaction methods between a smartphone and a timepiece having two analog-type pointers, each of the pointers being controlled independently by a stepper motor, the timepiece and the smartphone being able to be in communication through a wireless remote short-range communication link, the calibration method comprising the steps of S1—capturing image(s) of the watch with the smartphone, S2—processing the image(s) to determine accurately the displayed angular positions of the pointers, S3—send correction data from the smartphone to the watch, S4—carry out, at the watch, an appropriate correction so that the pointers are caused to display the current absolute time, the absolute time set method comprising the steps of S11—send absolute time reference from the smartphone to the watch, S12—carry out, at the watch, an appropriate correction, to update the internal counters and positions of the pointers so that the pointers display the current absolute time.

4 Claims, 4 Drawing Sheets

(56) References Cited

U.S. PATENT DOCUMENTS

| | | | | |
|---|---|---|---|---|
| 7,081,905 | B1 * | 7/2006 | Raghunath | G04G 5/00 345/684 |
| 7,167,417 | B2 * | 1/2007 | Akahane | G04C 9/02 368/155 |
| 7,474,594 | B2 * | 1/2009 | Urano | G01S 19/14 342/357.52 |
| 7,946,758 | B2 * | 5/2011 | Mooring | G04B 37/005 368/276 |
| 8,284,633 | B2 * | 10/2012 | Lazaridis | G04G 13/026 368/109 |
| 8,467,271 | B2 * | 6/2013 | Hirokawa | G04B 19/247 368/37 |
| 8,873,342 | B1 * | 10/2014 | Boudreaux | G04B 37/0083 368/46 |
| 9,001,625 | B2 * | 4/2015 | Essery | H04W 88/02 368/46 |
| 2004/0120222 | A1 | 6/2004 | Born et al. | |
| 2004/0233788 | A1 * | 11/2004 | Plancon | G04B 19/082 368/11 |
| 2004/0233792 | A1 | 11/2004 | Alleway | |
| 2013/0018284 | A1 * | 1/2013 | Kahn | G04G 13/026 600/595 |
| 2013/0033970 | A1 * | 2/2013 | Miyake | G04C 3/146 368/80 |
| 2013/0064045 | A1 * | 3/2013 | Essery | H04W 88/02 368/47 |
| 2014/0204718 | A1 * | 7/2014 | Heinberg | G06Q 10/109 368/47 |

* cited by examiner

ANALOG TYPE WATCH AND TIME SET METHOD

FIELD OF THE DISCLOSURE

The present invention concerns analog-type watches and systems and methods of time setting of such watches using a smartphone interaction.

BACKGROUND OF THE DISCLOSURE

In the known art, analog-type watches comprise a button available to the user for time setting operation. The time setting button allows to move the pointers (also called 'hands'), namely the hour pointer and the minute pointer. The time setting operation requires user attention and skill and the result is often not accurate. There is therefore a need to render more reliable and also simplify systems and methods of time setting of such analog-type watches.

Also, most analog-type watches have a reduction gear linking the hour and minute pointers. A way to simplify the structure of analog-type watches is to decouple hour and minute pointers. In this configuration, each of hour and minute pointers are controlled independently via a stepper motor, as disclosed in document US52991737. This simplifies the mechanic arrangement and allows enhanced functionalities but requires more complex electronic control. In this configuration, however, the risk of inadvertent leap of one of the pointer is increased, for example in case of shock, electromagnetic interference or in case of low power supply. When the pointers are controlled in open loop mode, (i.e. without any position sensing feedback, only with a software zero-position), this may lead to a deviation between the assumed position (from the watch controller standpoint) and the actual position of the pointer(s). This situation requires a re-calibration of the pointer position with regard to a reference position (usually 12:00).

Also, when the power supply has been interrupted, the controller may have lost the knowledge of the positions of the pointers.

Therefore, there is a need to bring new solutions to time setting and calibration of pointers in analog-type watches with pointers independent control.

SUMMARY OF THE DISCLOSURE

According to a first aspect of the present invention, it is disclosed an interaction method between on the one hand a smartphone or a tablet and on the other hand a timepiece having at least two analog-type pointers, each of the pointers being controlled independently by a stepper motor and referenced relative to a (software defined) zero-position, the timepiece and the smartphone being able to be in communication through a wireless remote short-range communication link, the method comprising the steps:

S1—capturing image(s) of the watch with the smartphone,

S2—processing the image(s) to determine accurately the displayed angular positions of the pointers, S3—send correction data from the smartphone to the watch, said correction data comprising the so-determined displayed angular positions of the pointers, and/or angular deviations from a reference position, S4—carry out, at the watch, an appropriate correction so that the pointers are caused to display the current absolute time, whereby a possible pointer inadvertent drift can be corrected very easily.

Thanks to these dispositions, whenever needed, the user/owner of the watch can use the above method to recalibrate the position of the pointers, at any time, but in particular after a power supply disruption (change of battery or battery exhausted).

In various embodiments of the invention, one may possibly have recourse in addition to one and/or other of the following arrangements:

- the timepiece is a wristwatch with an hour pointer and a minute pointer arranged coaxially, thereby a conventional aspect of the watch is provided,
- during step S1, an overlay with a special frame is provided on the screen of the smartphone to improve alignment of the watch while shooting image(s) with the smartphone, whereby easing the subsequent processing of the image(s),
- the hour pointer and minute pointer are configured to display current time as default function, and configured to display other type of information for a certain period upon user touch activation on the screen of the watch, or upon reception of a notice from the smartphone, thereby the decoupling and easy mobility of pointers are used to provide additional information on top of time display,
- the wireless remote short-range communication is Bluetooth low energy BLE interface, thereby providing energy efficiency.

According to a second aspect of the present invention, it is disclosed an interaction method between on the one hand a smartphone or a tablet having an absolute time reference of the current time zone, and on the other hand a timepiece having at least two analog-type pointers, each of the pointers being controlled independently by a stepper motor and referenced relative to a zero-position, the timepiece and the smartphone being able to be in communication through a wireless remote short-range communication link, the method comprising the steps:

S11—send absolute time reference from the smartphone to the watch,

S12—carry out, at the watch, an appropriate correction, to update the internal counters and positions of the pointers so that the pointers display the current absolute time, whereby the watch is automatically and accurately set to the time; also when a change of time zone happens, the watch is automatically set to the appropriate time zone current time; also the summer/winter time is handled automatically. In other words, the watch is automatically set to the absolute local time.

Advantageously, steps S11 and S12 are performed as soon as a time zone change is detected by the smartphone or whenever a winter/summer time change is detected by the smartphone. Thereby, the watch is automatically set to the absolute local time, as soon as a change is detected.

According to a third aspect of the present invention, it is disclosed an timepiece having at least two analog-type pointers, each of the pointers being controlled independently by a stepper motor and referenced relative to a zero-position, said timepiece being deprived of time set button/actuator, said timepiece being able to enter in communication with a smartphone or a tablet through a wireless remote short-range communication, whereby the time setting operation or pointers calibration can be performed through an interaction with the smartphone. Thereby, there is no need to provide a time set button/actuator on the timepiece, thereby simplifying the mechanical structure and reducing the costs.

In various embodiments of the invention, one may possibly have recourse in addition to one and/or other of the following arrangements:

- The timepiece is formed as a wristwatch with a hour pointer and a minute pointer arranged coaxially, thereby a conventional aspect of the watch is provided,
- The timepiece may further comprise an accelerometer and at least one additional indicators; thereby providing support for auxiliary functions;
- The timepiece may further comprise at least one biological parameter sensor(s); thereby providing collection of biological data related to the user;
- The hour pointer and minute pointer are configured to display current time as default function, and configured to display other type of information for a certain period upon user touch activation on the screen of the watch, or upon reception of a notice from the smartphone; thereby the decoupling and easy mobility of pointers are used to provide additional information on top of time display;
- The timepiece may further comprise optical marks that are provided at the tip of the pointers, and possibly at the axis (A) and at 12 h.

BRIEF DESCRIPTION OF THE DRAWINGS

Other features and advantages of the invention appear from the following detailed description of one of its embodiments, given by way of non-limiting example, and with reference to the accompanying drawings, in which.

DETAILED DESCRIPTION OF THE DISCLOSURE

In the figures, the same references denote identical or similar elements.

Figure 1:
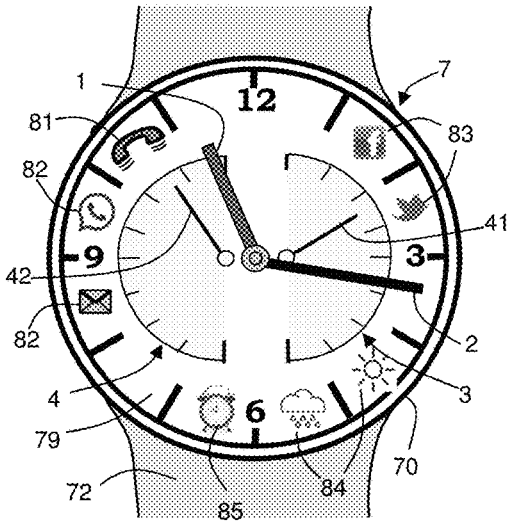
FIG. 1 shows a front schematic view of a watch according to an exemplary embodiment of the invention.

FIG. 1 shows a wrist watch 7 having several pointers (1,2), thereby forming an analog-type watch. It should be noted that each pointer is a physical pointer (also called 'hand') formed as a flat thin strip of rigid material fixed to a hub able to rotate around an axis A.

For time indication in the shown example, there are provided two pointers, namely a hour pointer 1 and a minute pointer 2. In the shown example, these two time pointers are arranged coaxially, as conventionally known, and are configured to rotate around a central axis A.

It is important to state that the present disclosure can also be applied to other type of analog-type timepieces, for example a wall clock.

The watch comprises a housing 70 attached to a wrist strap 72 ('wristband'), and a transparent cover 71 above the pointers, as known per se. In the present example, the assembly which comprises the housing 70 and the cover 71 forms a watertight assembly, so the user can swim with the watch. A dial 79 is provided on the peripheral border of the top visible face 75.

Besides the two pointers 1,2 already commented, the exemplified watch 7 includes two other, auxiliary, analog-type indicators 3,4 with pointers 41, 42.

Like hour and minute pointer, the auxiliary analog-type indicators 3,4 are flat thin strip of rigid material fixed to a hub able to rotate around an axis. Pointer 41 is rotatably mounted around axis A3. Pointer 42 is rotatably mounted around axis A4.

The first auxiliary indicator 3 is basically configured to display the daily number of steps done by the user. There may be provided like a gauge 0-10,000 steps.

The second auxiliary indicator 4 may be configured, according to a user-driven configuration to display either the daily caloric burn, or the exterior temperature, or the user's heart rate, or the user's blood pressure, or the user's weight, or any other user related information.

Figure 2A:
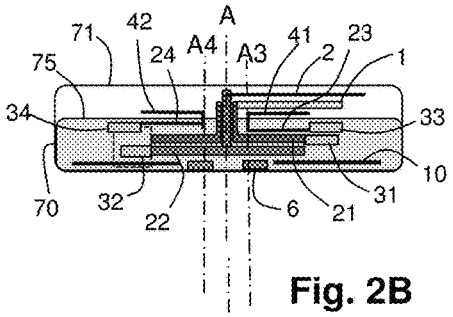
FIG. 2A is a side sectional view of the watch of FIG. 1.
Figure 2B:
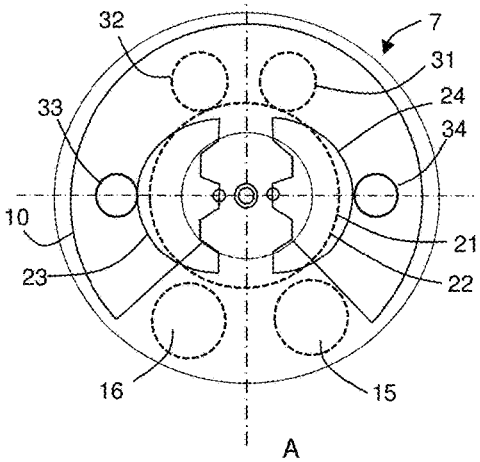
FIG. 2B is a top sectional view of the watch of FIG. 1.
Figure 3:
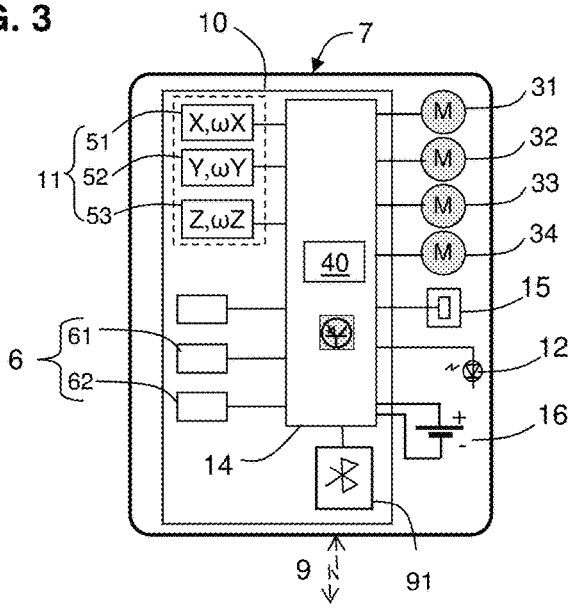
FIG. 3 is a functional block diagram of the watch of FIG. 1.

Inside the housing 70 are enclosed the following items, in reference to FIGS. 1-3:

- an electronic board (PCB) 10, with a controller 14, and an oscillator,
- a first stepper motor 31 to drive the first pointer namely the hour pointer, via a disklike plate 21
- a second stepper motor 32 to drive the second pointer namely the minute pointer, via a disklike plate 22,
- a third stepper motor 33 to drive the third pointer, via a disk-portion-like plate 23,
- a fourth stepper motor 34 to drive the fourth pointer, via a disk-portion-like plate 24,
- a battery 16, either conventional or rechargeable,
- a vibrator 15, to generate vibrations intended to be sensed by the user,
- an accelerometer 11, to sense the accelerations particularly the accelerations induced by the movements of the user, and also sense a 'tap' action of the user on the watch,
- biological sensor(s) 6, like optical sensor using photoplethysmography, or piezoelectric sensors, or temperature sensor, or else,
- a Bluetooth™ wireless coupler 91, configured to establish a wireless communication 9 with another device like a smartphone, or other devices,
- electroluminescent diodes (Leds) 12, to 'select' optically pictograms, or to serve as general backlight.

Of course, various other sensors can be envisaged like environmental sensors, pollutants sensors, atmospheric pressure sensor, light intensity sensor, etc. . . .

Instead of Bluetooth, any wireless remote short-range communication link can be used.

Each of the pointers is independently controlled by one stepper motor (31,32), via a disklike plate, in either direction (clockwise or counterclockwise).

First disklike plate 21 is located below second disklike plate 22, the central hub of disklike plate 21 traverses a central bore provided in the second disklike plate 22 (FIG. 2A). Disk-portion-like plate 23 carrying the third pointer 41 is offset from main axis A, and can rotate in the shown example of 180° around axis A3. Disk-portion-like plate 24 carrying the fourth pointer 42 is diametrically offset from main axis A, is located above disk-portion-like plate 23, and can also rotate in the shown example of 180° around axis A4.

Of course, the space distribution of disks and stepper motors can be different.

Each pointer is referenced relative to a zero-position, also known as a base reference position, which is formed as a 'software' zero-position; indeed, there is no sensing means to detect whatsoever the position of the pointer.

As known per se, the oscillator outputs a periodic signal, usually having a frequency above some kHz, this signal goes through one or more frequency divider(s) to result in a 1 Hz tick signal, which is used to increment the time internal counter(s) 40. Internal counters reflecting second, minute and hour are used to control the normal clockwise displacement of the pointers.

Hence, the controller 14 counts the steps imparted to each stepper motor from the 'software' zero-position, and constantly keeps record of the number of steps done from the base reference position, this count reflecting normally the current physical position of the pointer; in the shown example, the reference position is taken at 12:00; though another reference position can be chosen.

However, an initial step is required to 'teach' the reference position to the controller, since there is no sensor (no feedback) to sense the physical position. This is necessary after the first power-up of the watch.

Also the current position of the pointer may be lost in case of power supply disruption (change of battery or battery exhausted), especially if no non-volatile memory is available; if so, a new teaching is required. Even if non-volatile memory is used to save periodically the value of the internal counters, since this is time and energy consuming, the frequency of savings cannot be fast. Therefore, in case of power supply disruption, the current pointer position is different from the last saved position; in this case also, a new teaching is required.

Also, even without any problem of power supply disruption or loss of reference position, there is a risk of pointer leap or skip, for example if a shock is undergone. Also, an electromagnetic interference can prevent proper operation of the stepper motor control, causing a step loss, or a powerful spike can also trigger an inadvertent leap of the pointer without intentional control.

As a result, there may be a 'drift' of the pointer, i.e. the actual position of the pointer is different from the 'known' position from the controller standpoint.

For all these reasons, it is required to carry out a calibration, (or re-calibration) of the pointer.

Pointer Calibration

Figure 4:
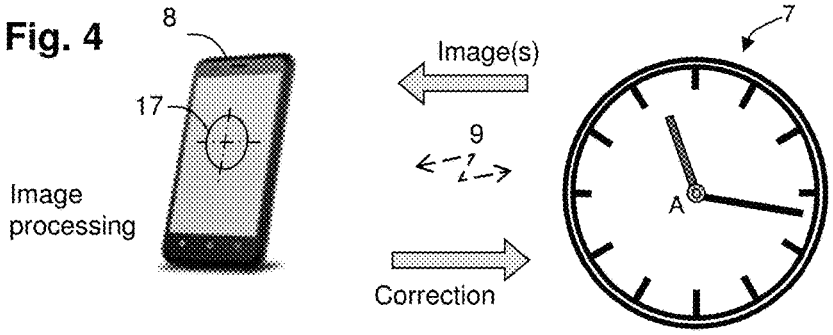
FIG. 4 illustrates the disclosed method involved a smartphone and the watch of FIG. 1.

Advantageously, an interaction with a smartphone 8 is performed to do so (FIG. 4). Instead of the smartphone, a tablet, a phablet, or any internet enabled mobile device can also be used. For the calibration method, it is even possible to use a Bluetooth enabled camera.

The calibration method comprises a first step S1, in which at least a picture (image) of the watch is taken at the smartphone. The image is then analysed by a software module in the smartphone, in order to determine the actual position of the pointers (step S2).

Note that several images can be taken, or a short video can also be used at steps S1 and S2. The outcome of S2 gives the respective deviations of the hour and minute pointers 1,2 with respect to the vertical upright position (12:00) known as reference. A detailed example is given below.

At step S3, the smartphone sends correction data to the watch. According to one possibility, said correction data comprises the so-determined displayed angular positions of the pointers. This information is sent through the wireless channel, preferably Bluetooth, promptly after the image capture step. The smartphone may also send in addition the absolute time, more precisely the absolute time of the time zone in which the smartphone is located.

At step S4 the watch 7 receives the correction data. If the base reference positions are deemed to be still valid (not lost), then the watch compares, for each pointer, its known position of the pointer (the position indicated by the internal counters) with the received position; if a deviation exists, then a correction is imparted with the stepper motor so that the pointer display the current absolute time. The same process applies for hours and minute pointers.

If the reference position has been lost, first the watch 7 acquires the absolute time and stores it in its counters 40, and then compares the received positions with the absolute time; the difference is then used to apply a correction to the steppers motors so that the pointers are caused to display the current absolute time; also the received positions are used to define again the reference positions.

Instead of 12:00, deviations from a reference position elsewhere in the dial can also be used.

Figure 5:
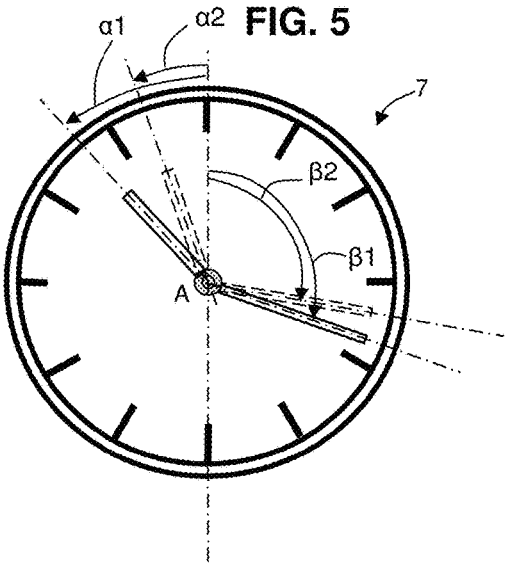
FIG. 5 illustrates the re-calibration which compensates for a pointer inadvertent leap or a loss of zero-position.
Figure 5A:
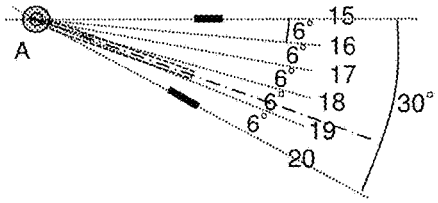
FIG. 5A is an enlarged view of FIG. 5 showing angular construction.
Figure 6:
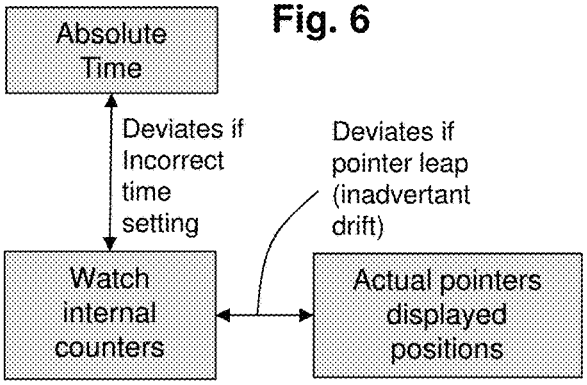
FIG. 6 illustrates various time data and deviations therefrom.

More precisely, with reference to FIG. 5A, the hour pointer 1 movement has a resolution of 3°, 10 steps are necessary to run the interval of 1 h, 120 steps for a complete revolution. In normal operation, the hour pointer may be controlled to be moved clockwise one step every 6 minutes.

The minute pointer 2 movement has a resolution of 2°, 3 steps are necessary to run the interval of 1 minute, 180 steps for a complete revolution. In normal operation, the minute pointer may be controlled to be moved clockwise one step every 20 seconds.

As shown in FIG. 5, the actual displayed angular position of the hour pointer 1 exhibits a position (bold line) having an angular deviation of al with regard to the base reference position namely 12:00.

However, the known position from the watch controller standpoint exhibits an angular deviation of $\alpha 2$ (dotted line) with regard to the same reference position (meaning some step have been missed). Therefore, calibration requires that the hour pointer be moved of $\alpha 2$-$\alpha 1$ in the clockwise direction, so that the displayed position is made to be consistent with the position known to the watch.

Similarly, the actual displayed position of the minute pointer 2 exhibits a position (bold line) having an angular deviation of $\beta 1$ with regard to the reference position.

However, the known position from the watch controller standpoint exhibits an angular deviation of $\beta 2$ (dotted line) with regard to the same reference position (forward leap may have occurred). Therefore, calibration requires that the minute pointer be moved of $\beta 2$-$\beta 1$ in the anticlockwise direction, so that the actual displayed position is consistent with the position known to the watch.

In an alternative embodiment, the required corrections might be computed by the smartphone 8, not by the watch, and in this case, the watch 7 has to send the assumed pointers positions to the smartphone. In this case, the smartphone compares the watch assumed positions to the positions determined by the image analysis, and output required correction to be sent to the watch 7 and to be implemented at the watch. In this alternative embodiment, the reference position is taken as the assumed pointers positions received from the watch 7. It is not necessary to refer to the base reference position (12:00). The correction is computed relative to the assumed positions received from the watch. This alternate solution works also if the image analysis requires some time, no lag is involved.

Optionally, especially in case several images (or a video) are shot, there may be provided a special calibration mode at the watch, during which the pointers are caused to be at a constant position. This provision avoids to undergo a step on one of the pointer during the image shooting, this step would be detrimental to the precision of the imagine(s) analysis.

Figure 7:
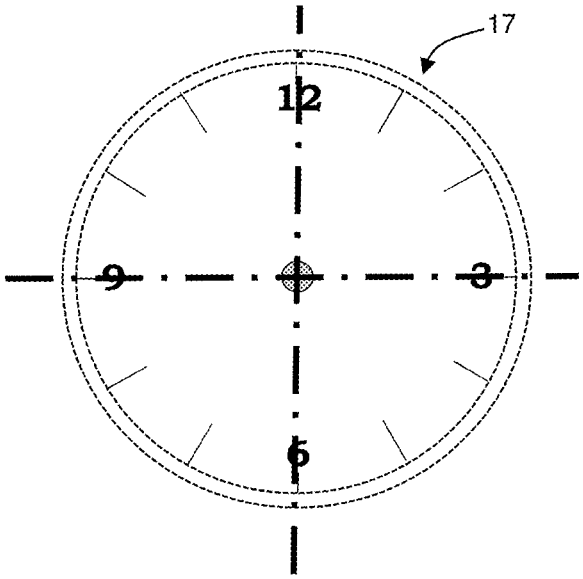
FIG. 7 illustrates an overlay involved when shooting the watch.

In order to facilitate the determination of the position of the pointers, there may be provided at the smartphone 8 an overlay 17 that can be used to align the watch picture, as shown in FIG. 7. This overlay can be formed as a graphical frame having orthogonal dotted lines crossing at a centre point and optionally a mockup of a watch as shown or concentric circle dotted lines.

Figure 9:
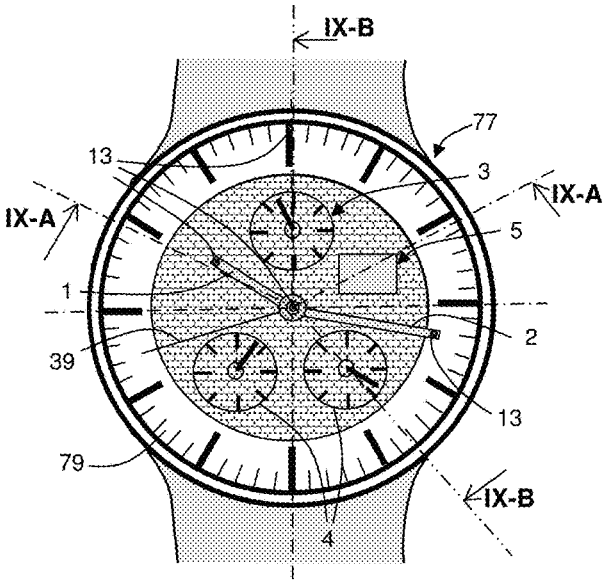
FIG. 9 is analogous to FIG. 1 and illustrates another embodiment.
Figure 9A:
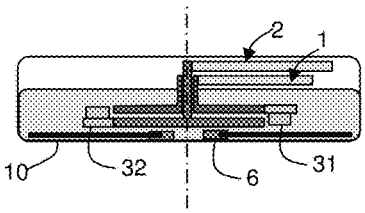
FIGS. 9A and 9B are analogous respectively to FIGS. 2A and 2B with regard to the watch of FIG. 9.
Figure 9B:
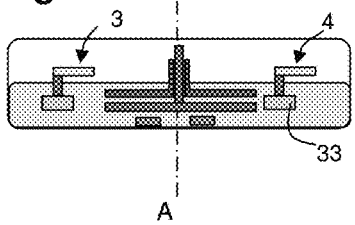

Alternatively, there may be provided optical marks 13 at the tip of the pointers as shown in FIG. 9. Also, there may be provided optical marks at the axis location A, and at 12*h* dial mark. The optical marks 13 may be different from each other to facilitate identification; for example a small square, a small round, a small triangle forms can be used.

These two features (overlay 17 and optical marks 13) can be used separately or commonly and are intended to facilitate the subsequent analysis of image(s).

Automatic Time Update

Even though calibration is not necessary, according to a second aspect of the disclosed invention, an interaction method can be used to keep updated the time setting of the watch, including when the user is travelling and changing timezone, or when a change from winter time to summer time or conversely occurs at the place where the user lives.

Every now and then, or on a periodical basis, the smartphone 8 sends to the watch 7 the absolute time prevailing at current season and geo-location, (also called "absolute local time").

If a deviation exists with regard to the internal time known in the internal counters, those counters are caused to be a updated to match with the absolute local time, and also the corresponding position of the pointer(s) is changed consistently if required.

In other words, the above method comprises the following steps:

S11—send absolute time reference from the smartphone 8 to the watch 7,

S12—carry out, at the watch 7, an appropriate correction, to update the internal counters and positions of the pointers so that the pointers are caused to display the current absolute time, Since the movement of each pointer can be made independently and in either direction (clockwise or counterclockwise), the update can be performed very promptly in any case; for winter/summer change, it requires moving forward or backwards the hour pointer 1 along a 30 degree range (i.e. 10 steps); for time zone change, it requires moving forwards or backwards the hour pointer 1 one or several step(s) of 30 degree. It does not require a lengthy adjustment like in the case of the prior art.

The movement of the pointer, when updating time, can be accompanied by a vibration of the vibrator 15, in order to notify the time change to the user.

Therefore, the above process provides a complete automatic update of the absolute local time at the watch 7, without any attendance from the user's side. It should be noted that any Internet enabled device can provide the absolute local time to the watch 7.

As shown in FIG. 9, which shows a variant embodiment, a second pointer 39 can also be provided in the watch 77. If present, this second pointer 39 generally displays the current second count, but can also displays another type of information as it will be seen later.

A digital pixelated area 5 is also provided. Any data can be displayed in this pixelated area 5; notably the current day in the month; current outside temperature; the measured weight of the user received from a wireless scale; the measured heart rate of the user, the duration of last night's sleep; etc. . . .

Also, optionally, a background dial display 79 may be a LCD display that can be controlled by the controller 14 of the watch, the use of which will be explained later.

Auxiliary Functions

According to a third aspect of the disclosed invention, the first and second pointers 1,2 may be used to display something else that the current time. During normal operation, the hour pointer 1 and minute pointer 2 are configured to display current time as default function; however, upon reception of a notice from the smartphone or upon user interaction, other functions can be displayed, also known as auxiliary functions.

A first category of auxiliary function relates to notification for the user. Various pictograms 81-85, either always visible or light-selectable, are distributed around the peripheral dial 79.

Figure 8:
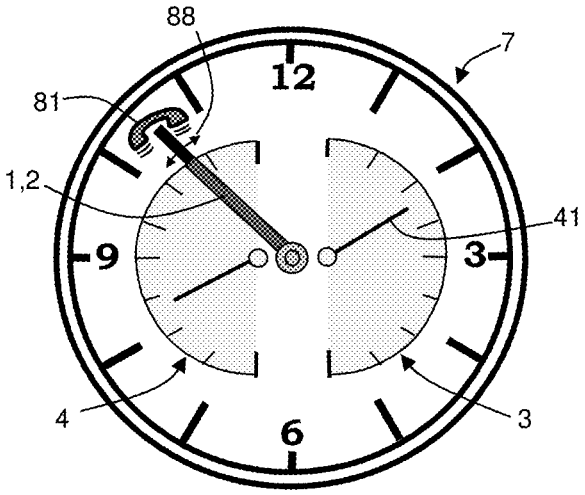
FIG. 8 is analogous to FIG. 1 and illustrates a notification mode of the watch of FIG. 1.

For example, a small telephone pictogram 81 lies between '10' dial mark and '11' dial mark. Whenever an incoming call arrives at the smartphone 8, the latter transmits a call notification to the watch through the wireless link 9. At this moment, the watch 7 begins a notification sequence by changing the functional purpose of one or several pointer(s). As exemplified in FIG. 8, hour and minute pointers 1,2 are temporarily moved to the middle position between '10' dial mark and '11' dial mark. The vibrator 15 may be energized at the same time to notify the user.

If present, the second pointer 39 can be used instead of hour or minute pointer.

There may be a small oscillation of the pointer(s) pointing at the small telephone pictogram. The small telephone pictogram may additionally blink or change color, if light selectable.

After a predefined notification period expires, the pointers return to the conventional time display.

The notification sequence can also be stopped upon user 'tap' action or touch actuation. A user 'tap' action is a sequence of one or several small impacts from the user's finger on the watch. In the case of the watch is not equipped with a touch top surface, 'tap' actions are defined to allow user interaction with the watch.

A gesture of the user can also be used as user interface, e.g. predefined acceleration patterns are defined to correspond to intentional gesture(s) of the user, for example moving up and down twice quickly, twisting twice, or any other gesture sequence(s).

Similarly, other pictograms 82-83 may be indicative of other external event, an email message reception, social network message, etc. . . .

Among other types of encompassed notifications, there can be provided notification(s) upon warning from a baby monitoring device, or from a home monitoring device, notification upon warning from pollutants detector (weighing scale or specific device) located in the room or bedroom.

Each notification can be accompanied by a dedicated vibratory sequence on the vibrator 15.

Weather forecast notification can also be displayed with the help of related pictograms 84, for example an impending rain or sudden shower can be notified to the user. Said weather forecast notifications are in the present case received from the smartphone 8.

Pictograms 81-85 may be advantageously light selectable pictograms.

In some embodiments, pictograms 81-85 can be formed with the help of LCD controlled background on the dial 79 (FIG. 9), in which a portion of the conventional time dial can be replaced by one or several notification pictogram.

A second category of auxiliary function is the snooze function. Although the setting of the alarm function is performed on the smartphone, a copied snooze notification is transmitted to the watch 7. A snooze pictogram 85 is shown between '6' dial mark and '7' dial mark.

Another auxiliary function is the magnetic compass. A magnetic sensor can be housed in the watch, and it is used to display the North direction with a special control of the minute pointer 2, which is in this case aligned with the North South direction, pointing at North.

Another auxiliary function is the display of barometric pressure. An atmospheric pressure sensor can be housed in the watch, and the controller 14 can use the sense pressure to display a barometric conventional display, i.e. current atmospheric pressure and current variation (equivalent to weather forecast as known per se).

Also, the controller 14 can also use the atmospheric pressure information to infer the current altitude and to display the current altitude, upon user interaction in the pixelated area 5 or with the help of one of the pointers 1,2,41,42.

Another auxiliary function is the display of real time blood pressure of the user. In this configuration, the wrist band or wrist strap 72 houses a blood pressure sensor (not shown at figures), coupled to the controller 14. Real-time blood pressure is sensed and displayed with the help of one of the pointers, the user can see the "ticks" (pulses) of his/her own heart. Besides, the low and high figures of the arterial blood pressure can also be displayed on the pixelated area 5.

According to a fourth aspect of the disclosed invention, the watch acts as a biological data collector. There is provided an optical transmitter 61 (Led) and an optical receiver 62 (photodiode), to measure the user's heart rate through photo-plethysmography (PPG).

There may be provided as well electrodes to measure the user's heart rate through electrocardiogram (ECG).

There may be provided as well the temperature sensor to measure the user's body temperature.

All the biological parameters can be used locally at the watch 7 (for example the already mentioned display of the heart rate), and can also be transmitted to the smartphone 8 for further analysis.

Miscellaneous

Regarding now the battery 16, the battery can be a conventional battery or rechargeable battery. The energy recharge of the battery can result from photovoltaic cells arranged on the cover window 71. Another possible embodiment uses the Seebeck effect, and a temperature difference between the skin of the user and the housing 70 of the watch 7.

Regarding now the acceleration sensor 11, it is preferably a multi-axis accelerometer having X,Y,Z sensing axis 51,52, 53.

The user-prompted temporary mode and/or notification-prompted temporary mode can be exited by a special user interaction, 'tap' pattern or the like, on the front side of the watch.

A "demo mode" can be provided. One of the feature can be the 'pointer drop', as if the pointer was submitted only the gravity. Other feature of the demo mode can include funny movement of the pointers.

Advantageously, thanks to the simplicity of the disclosed methods, the oscillator of the watch needs not be very much precise, and therefore costs can be saved.

The invention claimed is:

1. Interaction method between on the one hand a smartphone or a tablet and on the other hand a watch having at least two analog-type pointers, controlled by a stepper motor and referenced relative to a zero-position, the watch and the smartphone being able to be in communication through a wireless remote short-range communication link, the method comprising the steps:

S1—capturing image(s) of the watch with the smartphone,

S2—processing the image(s) to determine accurately the displayed angular positions of the pointers, S3—sending correction data from the smartphone to the watch, said correction data comprising the so-determined displayed angular positions of the pointers, and/or angular deviations from a reference position, S4—carrying out, at the watch, an appropriate correction so that the pointers are caused to display the current absolute time, whereby a possible pointer inadvertent drift can be readily corrected, in which during step S1, an overlay with a special frame is provided on a screen of the smartphone to improve alignment of the watch while shooting image(s) with the smartphone, whereby easing the subsequent processing of the image(s).

2. The interaction method of claim 1, wherein the timepiece is a wristwatch with an hour pointer and a minute pointer arranged coaxially (A).

3. The interaction method of claim 1, wherein the hour pointer and minute pointer are configured to display current time as default function, and configured to display other type of information for a certain period upon user touch activation on the screen of the watch, or upon reception of a notice from the smartphone.

4. The interaction method of claim 1, wherein the wireless remote short-range communication is Bluetooth™ low energy BLE interface.

* * * * *